US008310191B2

(12) United States Patent
Schneider et al.

(10) Patent No.: US 8,310,191 B2
(45) Date of Patent: Nov. 13, 2012

(54) PIECE OF FURNITURE AND DEVICE FOR PUSHING OUT A FURNITURE PART WHICH IS ACCOMMODATED IN A MOVABLE MANNER ON A FIXED FURNITURE PART

(75) Inventors: Klaus Schneider, Höchst (AT); Holger Wenzel, Lindau (DE); Harry Gehrer, Höchst (AT)

(73) Assignee: Grass GmbH, Hochst (AT)

( * ) Notice: Subject to any disclaimer, the term of this patent is extended or adjusted under 35 U.S.C. 154(b) by 256 days.

(21) Appl. No.: 12/603,921

(22) Filed: Oct. 22, 2009

(65) Prior Publication Data

US 2010/0084953 A1 Apr. 8, 2010

Related U.S. Application Data

(63) Continuation of application No. PCT/EP2008/003511, filed on Apr. 30, 2008.

(30) Foreign Application Priority Data

Apr. 30, 2007 (DE) ..... 20 2007 006 301 U

(51) Int. Cl.
*H02P 7/00* (2006.01)
*H02P 3/00* (2006.01)

(52) U.S. Cl. ..... 318/466; 331/266; 331/646; 312/348.1; 312/319.1

(58) Field of Classification Search ..... 318/266, 318/466, 626, 646, 651; 312/331, 332, 319.1, 312/319.5, 319.7, 319.8, 348.1
See application file for complete search history.

(56) References Cited

U.S. PATENT DOCUMENTS

| | | | | |
|---|---|---|---|---|
| 7,159,957 | B2 * | 1/2007 | Huber et al. | 312/331 |
| 7,331,643 | B2 * | 2/2008 | Huber et al. | 312/319.5 |
| 7,602,135 | B2 * | 10/2009 | Huber et al. | 318/651 |
| 7,633,258 | B2 * | 12/2009 | Huber et al. | 318/646 |
| 7,780,251 | B2 * | 8/2010 | Dubach et al. | 312/319.7 |
| 7,868,578 | B2 * | 1/2011 | Scheffknecht et al. | 318/626 |
| 2003/0122459 | A1 * | 7/2003 | Huber et al. | 312/319.6 |
| 2003/0122519 | A1 * | 7/2003 | Huber et al. | 318/646 |
| 2004/0100169 | A1 * | 5/2004 | Huber et al. | 312/319.5 |
| 2006/0061245 | A1 * | 3/2006 | Huber et al. | 312/348.1 |
| 2006/0261775 | A1 * | 11/2006 | Huber et al. | 318/646 |
| 2007/0180654 | A1 | 8/2007 | Gasser | |
| 2009/0127990 | A1 * | 5/2009 | Dubach et al. | 312/319.1 |

(Continued)

FOREIGN PATENT DOCUMENTS

| | | | |
|---|---|---|---|
| AT | A362/206 | * | 3/2006 |

(Continued)

*Primary Examiner* — Paul Ip
(74) *Attorney, Agent, or Firm* — Burr & Brown

(57) ABSTRACT

The invention proposes a device for pushing out a furniture part which is accommodated in a movable manner on a fixed furniture part, having a pushing-out element which is driven via a drive unit and is present on one of the furniture parts in order to push the movable furniture part out of a closure position, the intention being for contact between the pushing-out element and the other furniture part to be eliminated during a pushing-out operation, and having a control unit for controlling the drive unit, the control unit taking as a basis a definable closure position of the movable furniture part for controlling the drive unit. The invention provides means by which, following a closing operation of the movable furniture part, a standstill position achieved in the process can be defined as a new closure position and replaces the closure position previously taken as a basis.

12 Claims, 5 Drawing Sheets

U.S. PATENT DOCUMENTS

| | | | | |
|---|---|---|---|---|
| 2009/0206715 | A1 * | 8/2009 | Scheffknecht et al. | 312/319.8 |
| 2010/0084954 | A1 * | 4/2010 | Schneider et al. | 312/319.1 |

FOREIGN PATENT DOCUMENTS

| | | | |
|---|---|---|---|
| DE | 20 2004 012 442 | U1 | 1/2006 |
| DE | 10 2004 045 568 | A1 | 3/2006 |
| DE | 603 06 596 | T2 | 6/2007 |
| DE | 20 2006 006 189 | U1 | 8/2007 |
| EP | 1 400 420 | A1 | 3/2004 |
| WO | 2006/017864 | A1 | 2/2006 |
| WO | WO 2007098515 | A2 * | 9/2007 |
| WO | 2007/122068 | A1 | 11/2007 |

* cited by examiner

PIECE OF FURNITURE AND DEVICE FOR PUSHING OUT A FURNITURE PART WHICH IS ACCOMMODATED IN A MOVABLE MANNER ON A FIXED FURNITURE PART

CROSS REFERENCE TO RELATED APPLICATIONS

This application is a continuation of International Application No. PCT/EP2008/003511, filed Apr. 30, 2008, which designated the United States, and claims the benefit under 35 USC §119(a)-(d) of German Application No. 20 2007 006 301.6 filed Apr. 30, 2007, the entireties of which are incorporated herein by reference.

FIELD OF THE INVENTION

The invention relates to a device for pushing out a furniture part that is accommodated in a movable manner on a fixed furniture part and to a piece of furniture.

BACKGROUND OF THE INVENTION

Devices for pushing out a movable furniture part, in particular for moving a drawer, door, shutter or the like, out of a closed position on a fixed furniture part with driving assistance over a certain distance are already known. It is possible here for a movable part of a piece of furniture to be moved with driving action out of a closure position, in particular over a comparatively short distance of the total movement path possible, in order then to be moved further manually by an individual. For example, it can easily be made possible, in the case of a drawer, for the drawer to be opened without it having to be made to move out of the closure position by hand, which in particular in the case of heavily loaded drawers may require a considerable amount of force to be applied. The drawer which is moved out only to a slight extent with driving action by the pushing-out operation is then considerably easier to move entirely manually. Moreover, movable furniture parts may be designed without a handle element on the outside since the pushing-out operation means that the movable furniture part can easily be gripped, for example, by way of a front section.

SUMMARY OF THE INVENTION

The object of the present invention is to provide a corresponding piece of furniture and a device of the type discussed above so as to make it possible in a technically and economically advantageous manner for a piece of furniture to be easier to use.

The invention is based, in the first instance, on a device for pushing out a furniture part which is accommodated in a movable manner on a fixed furniture part, having a pushing-out element which is driven via a drive unit and is present on one of the furniture parts in order to push the movable furniture part out of a closure position, the intention being for contact between the pushing-out element and the other furniture part to be eliminated during a pushing-out operation, and having a control unit for controlling the drive unit, the control unit taking as a basis a definable closure position of the movable furniture part for controlling the drive unit. One aspect of the invention is to provide a mechanism by which, following a closing operation of the movable furniture part, a standstill position achieved in the process can be defined as a new closure position and replaces the closure position previously taken as a basis. It is thus possible for triggering characteristics always to remain the same and/or for a triggering operation always to be reliably detected as such by an individual. In addition, the individual considers it to be fitting if the triggering operation, e.g. by pushing on a front of the relevant movable furniture part, always lasts the same length of time and/or the movable furniture part, when pushed, can always be pushed to the same depth up to a stop position, in order for this to be detected as a triggering operation.

This may be relevant in particular for furniture with so-called touch latch arrangements. For this purpose, a small closing or front gap is formed between the movable furniture part in its closure position and the fixed basic furniture structure, this gap being present on an operating side of the movable furniture part and counter-sections of the fixed basic furniture structure, for example being a few millimeters in width. The closing gap makes it possible, by pushing against the operating or front side of the movable furniture part in the direction of the basic structure, to execute a triggering operation. The triggering operation is detected as such and the control unit then reacts correspondingly. The movable furniture part is then pushed out with driving action via the pushing-out element. In order to avoid incorrect triggering, for example when the operating side is subjected to a pushing action which does not correspond to a pushing action for a desired triggering operation, it is necessary for the triggering characteristics for a triggering operation always to remain the same. It is fundamentally important for this purpose, however, for the closure position which is desired or taken as a basis to be known and to correspond to the actual closure position.

If, however, the actual closure position differs from the closure position which is taken as a basis in the control unit, malfunctioning or other unexpected pushing-out characteristics may occur. For example, it has not been possible to rule out the situation where, during the triggering operation, a triggering distance covered or the time taken during the triggering operation for the movable furniture part to reach a stop position is detected as being the "correct" triggering operation. In particular the distance covered during triggering and the time taken for the triggering operation are important to distinguish between "correct" and "incorrect".

Distinction is therefore necessary in order to avoid the situation where, for example, a comparatively long period of pushing against the operating side of the movable furniture part, as can take place for example when someone is leaning against the movable furniture part, or, for example, accidental brushing against the front of the furniture when someone is moving past it is understood as a triggering command.

The arrangement according to the invention makes it possible to take account of circumstances which may adversely affect the triggering characteristics, and to correct the same. For example, it is possible according to the invention for a closure position, which changes on account of unavoidable wear, not to have an adverse effect on the triggering characteristics over the service life of the pushing-out device. In this way, it is possible to take account, for example, of changes in the closure position over time, which are in particular only in the millimeter range, possibly only a few fractions of a millimeter, or in the range of tenths of a millimeter. Without the mechanism according to the invention, the triggering distance of the movable furniture part and the triggering time would change over time. Detection of the triggering operation then could not function precisely.

The mechanism advantageously configured to define a new closure position when, following the closing operation, the movable furniture part assumes a standstill position within a predeterminable region in the vicinity of a mechanical closing stop of the movable furniture part. As a result, only such standstill positions of the movable furniture part are used as a new closure position when the movable furniture part is also actually closed. "In the vicinity" means in particular a few centimeters or millimeters distant from the mechanical closing stop. This makes it possible, for example, to avoid the situation where a standstill position of the movable furniture part which is at a standstill at any location between a closure position and a fully open position is defined as a new closure position merely because the movable furniture part is no longer moving. This state can occur when, for example during movement of the movable furniture part, by jamming of an object between the movable furniture part and the fixed furniture part, or some other adjacent section, the movable furniture part has its movement mechanically blocked and comes to a standstill or, for example, also when the user does not want to close the movable furniture part completely.

Moreover, it is preferred if the means are designed to define the new closure position when, within a predefined period of time from the point in time at which the standstill position is reached, no significant movement of the movable furniture part takes place. It is then possible to ignore certain precisely definable states for the redefinition of the closure or zero position, for example when, during the closing operation, there are short periods of time without any movement of the movable furniture part, in which the movable furniture part momentarily assumes a standstill position although it has not fully reached the closure position, but definitively reaches this position following the short interruption.

The mechanism is preferably designed so as not to define a new closure position when, beyond a predefined period of time calculated from the point in time at which the standstill position is reached, there is no longer any significant movement of the movable furniture part taking place. It is thus possible to avoid, for example when an individual or an object leans against the movable furniture part for a relatively long period of time, the movable furniture part being moved as far as the mechanical closing stop and remaining there, the situation where this action is defined as a new closure position. It is thus possible to rule out the new closure position corresponding to the mechanical stop, whereas otherwise, in the case of touch latch arrangements, a triggering command for the movable furniture part would no longer be possible since pushing against the movable furniture part does not give rise to any triggering movement and it is thus not possible to trigger any opening movement. Moreover, it is possible, in principle, to rule out the situation where a new closure position is defined in the mechanical stop position, in which case, in particular for touch latch arrangements, a triggering action always remains possible.

Furthermore, it is possible for the mechanism to comprise one or more sensors for detecting a movement state of the movable furniture part. The sensor makes it possible to detect movement, or a standstill state, of the movable furniture part relative to the fixed furniture part and to supply relevant information to the control unit. Modern sensors operate precisely, are robust and can be used in a space-saving manner and are also compatible with the control unit and/or with correspondingly used computing units.

The sensors are preferably designed to detect the movement state of the movable furniture part indirectly via sensing of the movement of the pushing-out element. It is possible here to make use of the fact that during the closing operation, just prior to a mechanical closing stop being reached, that is to say states which are possible for defining the new closure position, the movable furniture part is in contact with the pushing-out element.

The pushing-out element can usually assume two positions when moved or pivoted back. A first rest position corresponds to a standby position when the movable furniture part is open or being closed. A further rest position arises when the pushing-out element comes into contact with the closing movable furniture part, it being possible for the pushing-out element to yield slightly out of its first rest position, in particular by virtue of resilient mounting of the pushing-out element, and the second rest position of the pushing-out element is reached, this position being used for defining the new zero or closure position.

It is possible here for the pushing-out element to behave, very precisely and with a high level of correspondence, like the movable furniture part and/or it is moved along in particular correspondingly in the same way and is at standstill precisely when the movable furniture part is also at a standstill. Sensing of the movement of the pushing-out element thus makes it possible for the movement state of the movable furniture part to be determined indirectly in a precise and reliable manner.

Furthermore, it is possible for the sensor to comprise two sensor parts, of which one sensor part is arranged on a fixed-position part of the pushing-out device or on the fixed furniture part and the other sensor part is arranged on the pushing-out element or on the movable furniture part. This makes it possible for the sensor to be accommodated in a flexibly positionable manner at preferred locations of the piece of furniture and/or of the pushing-out device. In particular the sensor can be positioned where particularly precise or even extremely small movements of the movable furniture part can be sensed directly or indirectly.

The sensor is particularly preferably a Hall sensor. A Hall sensor advantageously allows sensing in a relevant spatial region, which is beneficial precisely for defining the closure position. The Hall sensor comprises, for example, two sensor parts, of which one sensor part is fitted, in particular, in a fixed manner and the other sensor part is fitted in a movable manner, for example on the movable furniture part or on the pushing-out element. The sensor may also operate in some other way, in particular optically, inductively, capacitively, magnetically, using infrared or an incremental encoder, and the like.

Furthermore, it is possible that the sensor can feed to the control unit information relating to a sensed movement state of the movable furniture part. It is thus possible to use the sensing as a basis to feed to the higher-order control unit information relating to the movement state of the movable furniture part. This information can then be processed correspondingly in the control unit, in particular in order to define the new closure position. However, the new closure position is definitively defined in the control unit when, as explained above, appropriate requirements have been met, e.g. time-related and/or spatial requirements in respect of the triggering and/or closing operation.

The invention also relates to a piece of furniture with a furniture part which can be moved relative to a fixed furniture part, the piece of furniture having one of the devices described above. It is thus possible for the advantages which have already been disclosed to be realized for the piece of furniture, in particular for a piece of furniture with drawers, doors, shutters, swing doors, sliding doors and/or pull-out mechanisms and the like, which can be moved in relation to fixed-position sections.

It is advantageous in principle, in the case of the proposed arrangement, if, irrespective of the method of fitting the movable furniture part on the fixed furniture part, the pushing-out device can be fitted universally and/or can be easily retrofitted. In particular there is no need to take any additional measures for locking the movable furniture part in the closure position, since the movable furniture part can be retained in the closure position via conventional locking means, e.g. an automatic retraction mechanism.

Furniture parts are to be understood predominantly as furniture parts for kitchen furniture and furniture for the home in general, but the expression furniture parts, within the context of the invention, may also extend to drawers, doors and shutters on other arrangements, for example to a drawer on a tool cabinet or carriage.

BRIEF DESCRIPTION OF THE DRAWINGS

By way of the figures, further details and features of the invention will be explained in more detail using schematically illustrated exemplary embodiments. The figures use partially the same designations for corresponding components of different exemplary embodiments.

DETAILED DESCRIPTION OF THE INVENTION

Figure 1:
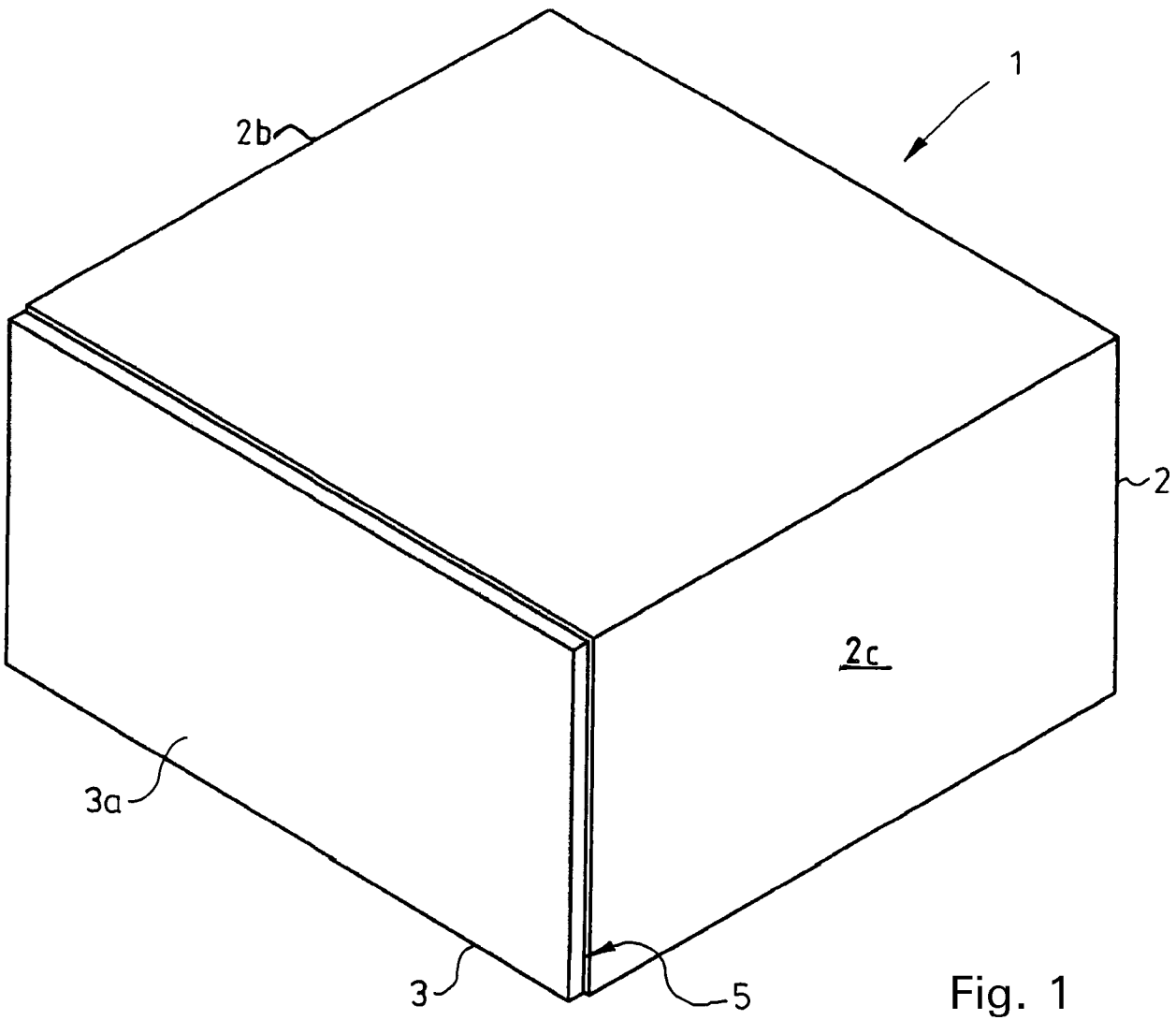
FIG. 1 shows a perspective view of a schematically illustrated piece of furniture with a drawer.
Figure 2:
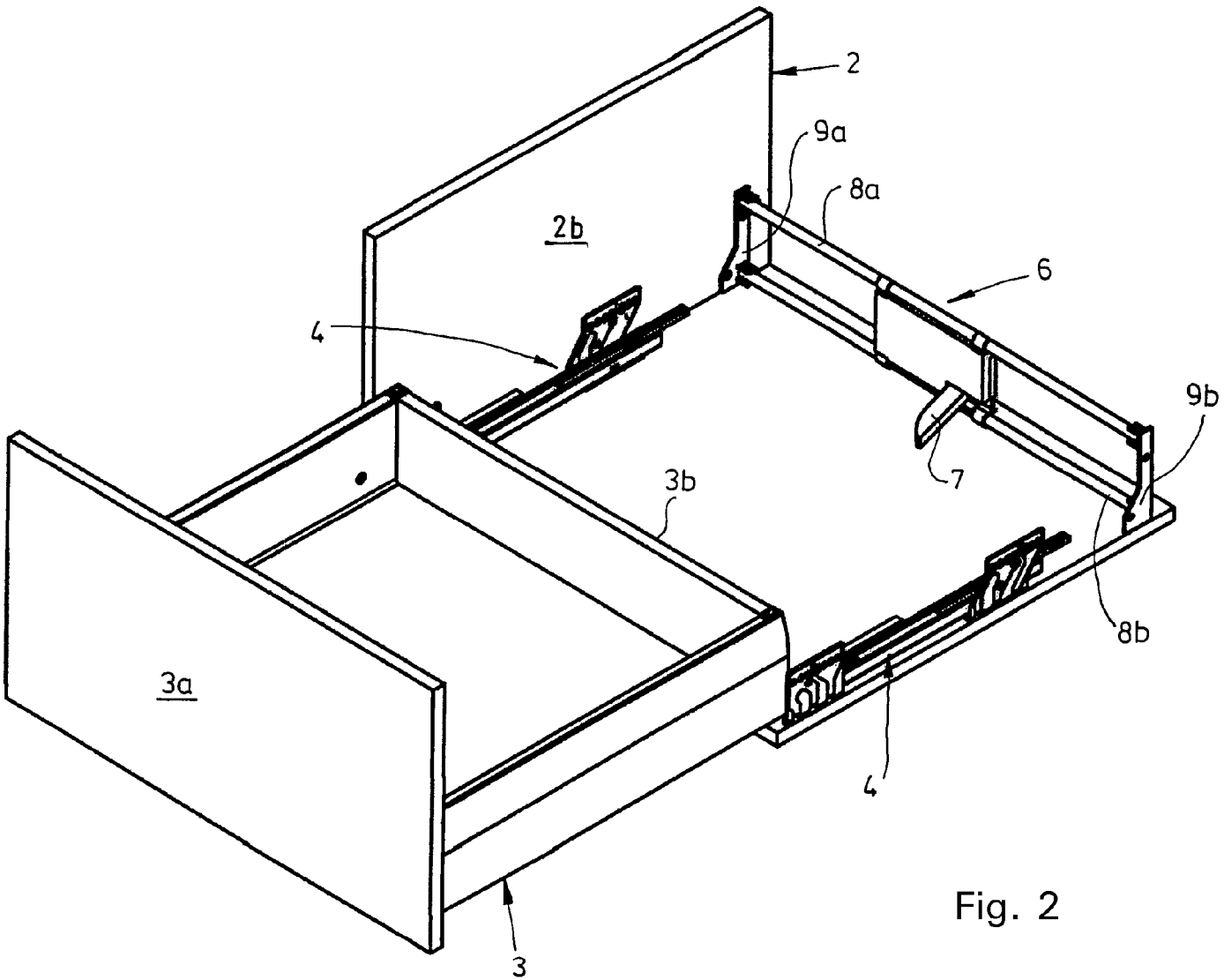
FIG. 2 shows the piece of furniture according to FIG. 1 with individual parts left out, the drawer being illustrated in the open state.

FIGS. 1 and 2 show a piece of furniture 1 with a basic structure 2 and a drawer 3 which can be displaced in the basic structure 2 via a pull-out guide 4. The pull-out guide 4 comprises, in particular, a full-extension mechanism which is known per se and has a drawer-mounted drawer rail, a basic-structure-mounted fixed rail and a central rail accommodated in a movable manner therebetween. In FIG. 1, the drawer 3 is located in a closure position in which a front gap 5 of for example a few millimeters is formed between the basic structure 2 and an inner side of a front portion 3*a* of the drawer 3. The front portion 3*a* does not have any handle in the example shown, although it is also possible for a handle to be present.

The front gap serves predominantly, by virtue of someone or something pushing on the front portion 3*a*, to allow a triggering command for a pushing-out operation in which the drawer 3 can be moved a few millimeters in the direction of the basic structure 2, with the front gap 5 being reduced in the process. A triggered pushing-out operation is executed by a pushing-out device 6 according to the invention. If, in the state shown in FIG. 1, the closed drawer 3 is pushed to some extent, a movement of the drawer can be registered via, for example, corresponding sensors (not illustrated), as a result of which a pushing-out operation is triggered by means of the pushing-out device 6.

FIG. 2 shows the fully open drawer 3 in the basic structure 2, which is shown without a side wall, rear wall and top part. A pushing-out lever 7 of the pushing-out device 6 is illustrated in a fully pivoted position. The pushing-out lever 7 can be pivoted for example in relation to the rear wall (not illustrated) of the basic furniture structure 2 through a maximum pivoting angle of approximately 80 to more or less 90 degrees or more. Pivoting of the pushing-out lever 7 causes the latter to butt against the outside of a rear wall 3*b* of the drawer 3, and the drawer 3 can push away out of a closure position, in particular can move out of the closed position according to FIG. 1 in the opening direction by a distance of, for example, approximately 30 to 70 mm. For this purpose, a drive unit concealed by a housing section moves the pushing-out lever 7 with driving action out of an abutting or swung-back position into the pivoting position shown in FIG. 2. Contact between the rear wall 3*b* and the pushing-out lever 7 is then eliminated, and the moving drawer 3 can move freely a bit further. Then, or preferably when the drawer moves freely a bit further, or as soon as there is no more contact between the rear wall 3*b* and pushing-out lever 7, in particular the drive unit pivots the pushing-out lever 7 back into the swung-back position in order to be ready for the next pivoting or pushing-out operation. When the pushing-out lever 7 is in the abutting position (not shown), its longitudinal axis is oriented approximately parallel to the rear wall 3*b* of the drawer and/or to crossmembers 8*a*, 8*b*.

The pushing-out device 6 is clipped in releaseably over the two crossmembers 8*a* and 8*b*. The two crossmembers 8*a*, 8*b* are themselves accommodated in accommodating flanges 9*a* and 9*b* which are fastened on the side walls of the basic furniture structure 2.

The pushing-out device may also be fastened on the drawer 3 and moved along therewith, in which case the pushing-out lever 7 can come into contact, for example, with the rear wall of the basic structure 2 at least for pushing-out purposes.

FIG. 2 shows the pushing-out lever 7 in its fully pivoted position, in order to give a good view of the pushing-out lever, although the pushing-out lever 7 is usually already located in its pivoted-back position, or in its rest position, again when the drawer 3 is fully opened.

Figure 3:
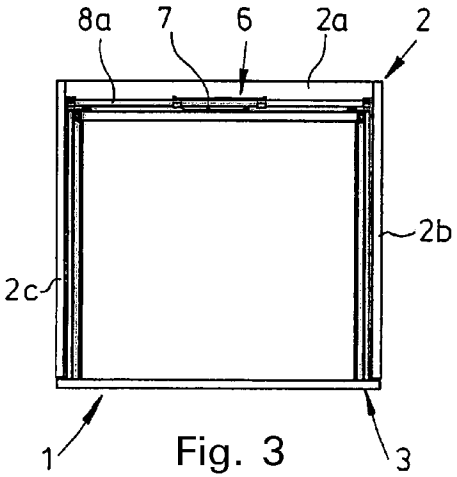

FIGS. 3 to 6 illustrate a piece of furniture 1 from above with a top side of the basic structure 2 left out, and this piece of furniture has a pushing-out device 6 which is modified in relation to the pushing-out device according to FIG. 2. The basic furniture structure 2 has a rear wall 2*a*, a right-hand side wall 2*b* and a left-hand side wall 2*c*. Moreover, the side walls 2*b* and 2*c* have crossmembers 8*a* and 8*b* according to FIG. 2 running between them, the pushing-out device 6 being fastened on these crossmembers. In FIG. 3, with the drawer 3 fully closed, the pushing-out lever 7 is straightened out or of rectilinear form and in a pivoted-back rest position. The pushing-out device 6 and the crossmembers 8*a*, 8*b* advantageously require only a comparatively small amount of installation space in particular in respect of the depth of the piece of furniture 1.

Figure 5:
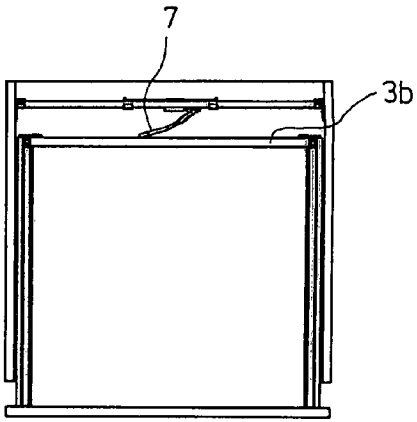
FIGS. 3 to 6 show a view from above of the piece of furniture according to FIG. 1 without a top part, the drawer being illustrated in different positions before, during and after a pushing-out operation.
Figure 4:
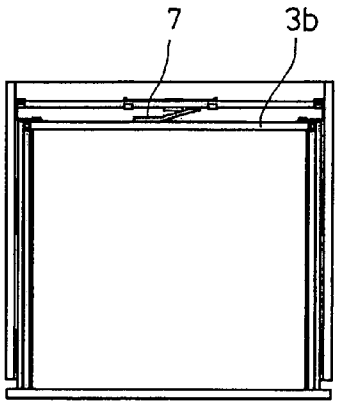

FIGS. 4 and 5 show the pushing-out lever 7 in an inflected form or with an inflection, it being possible for a front angled section of the pushing-out lever 7 to butt with surface-area contact (FIG. 4) or punctiform contact (FIG. 5) against a rear wall 3*b* of the drawer 3. The pushing-out lever 7 is pivoted somewhat further in FIG. 5 than in FIG. 4, the pivoting movement of the pushing-out lever 7 being effected by a drive unit (not illustrated specifically). By virtue of the pivoting movement of the pushing-out lever 7 and the abutment of the latter against the rear wall 3*b* of the drawer 3, the drawer 3 is moved a little way in the opening direction out of the closed position, which is illustrated in FIG. 3. The movement of the pushing-out lever 7 does not move the drawer 3 into the fully open position according to FIG. 6. Rather, the pushing-out movement by the pushing-out lever 7 moves the drawer 3 into a partly open position, from which for example an individual can open the drawer 3 further, or close it again, by hand. The movement sequence, however, could be optimized such that the drawer 3, with the follow-on mechanism, can be opened more or less or to the full extent.

Figure 6:
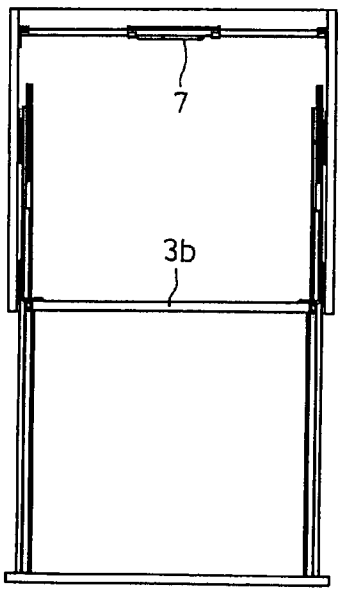

Following the pushing-out operation, the pushing-out lever 7 is pivoted back immediately, or shortly thereafter, into its rest position again, as shown in FIG. 6. The possibility of inflecting the pushing-out lever in an articulated manner means that the pushing-out lever 7, which is angled during the pushing-out operation, is fully straightened out again, and can be accommodated in a space-saving manner in the basic structure 2, in its rest position according to FIGS. 3 and 6.

Figure 7:
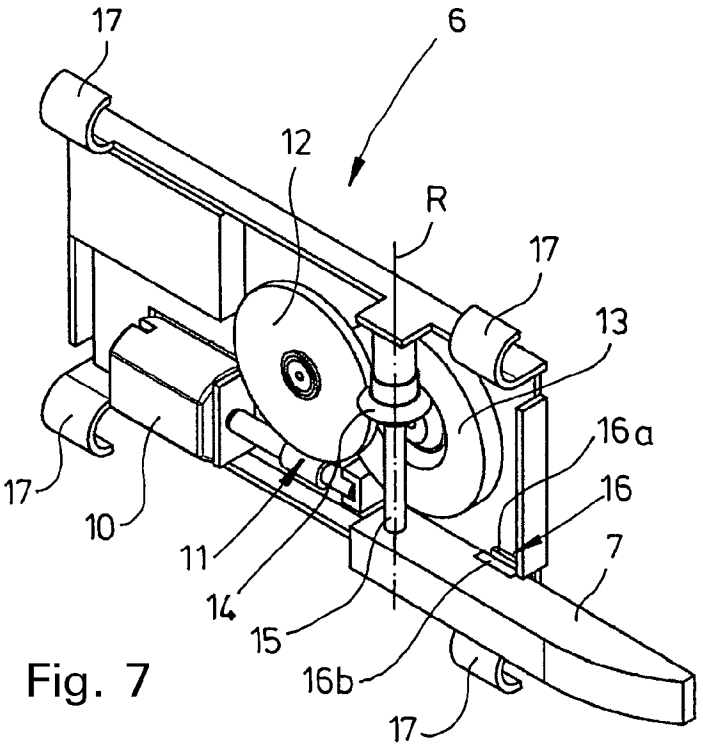
FIG. 7 shows a perspective exemplary embodiment of a pushing-out device according to the invention with a front housing left out.

FIG. 7 shows a somewhat more detailed view of a further pushing-out device 6 according to the invention with a pushing-out lever 7 which is located in a pivoted-back position or in a rest position. A front housing section of the pushing-out device 6 is not illustrated in FIG. 7, and this makes it possible to see parts used for the drive transmission from an electric motor 10 to the pushing-out lever 7. The individual components or structural elements are shown merely in a highly schematic manner in FIG. 7.

The pushing-out lever 7 is pivoted forward and back about the axis or rotation R via the electric motor 10 and a gear mechanism 11. The gear mechanism 11 and further gear-mechanism or transmission elements 12, 13 and 14 are provided for transmitting the rotary movement to the pushing-out lever 7, and they cause a rotary shaft 15, which is fixed in position on the pushing-out lever 7, to rotate.

For sensing a movement state of the pushing-out lever 7 and thus of a movable furniture part in the vicinity of a mechanical closing stop and/or for sensing a pivoting movement of the pushing-out lever 7, a sensor 16 is provided. The sensor 16 comprises a first sensor part 16*a* on a basic body of the pushing-out device 6 and a second sensor part 16*b* on a section of the pushing-out lever 7, this section being located in a radius region about the axis R which corresponds to the sensor part 16*a*. The sensor parts may comprise, in particular, an active or operating unit and a "passive" part which interacts therewith, for example, in the case of an optical sensor, the sensor part 16*a* could be an optical element and the sensor part 16*b* could be a reflecting element. The sensor parts 16*a*, 16*b* may be, in particular, parts of a Hall sensor.

Fitting clips 17 can be used to clip the pushing-out device 6, for example, on the crossmembers 8*a*, 8*b* according to FIG. 2. The pushing-out device 6 according to FIGS. 7 to 9 corresponds essentially to the pushing-out device 6 according to FIG. 2, a front housing part of the pushing-out device 6 having been left out.

When the pushing-out lever 7 is pivoted about the axis of rotation R, the sensor 16 can be used, within the region of action of the sensor 16, to sense the movement of the pushing-out lever 7 when the two sensor parts 16*a* and 16*b* are spaced apart from one another by a spacing which covers in particular all the relevant closure positions of the movable furniture part.

Figure 8:
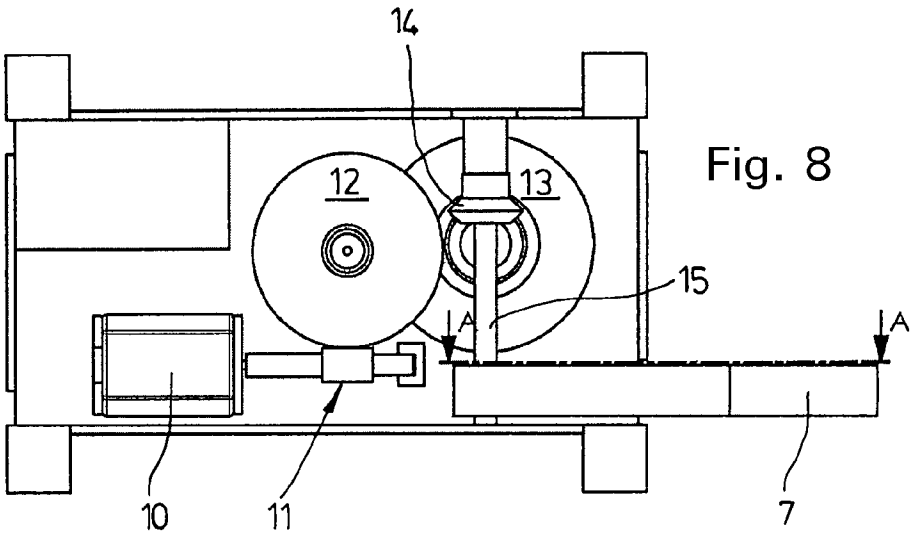
FIG. 8 shows a front view of the pushing-out device from FIG. 7.
Figure 9:
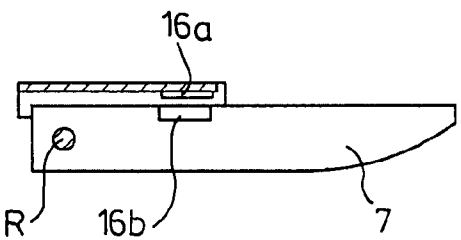
FIG. 9 shows a partly sectional illustration of the pushing-out device from FIG. 8 along line A-A from FIG. 8.
Figure 10:
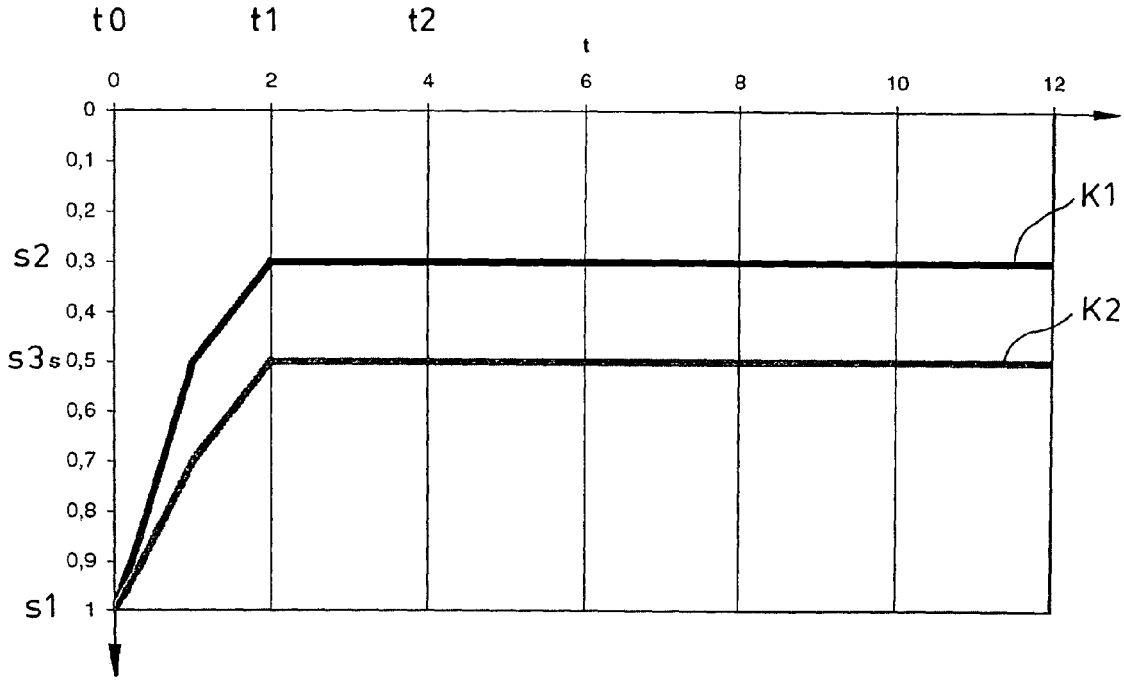
FIG. 10 shows a two-axis diagram for demonstrating the operation of defining a new closure position in two different closing operations.

Two different closing operations for a movable furniture part, for example according to FIG. 2 (Hall sensor is not shown in FIG. 2), which can be pushed out by a pushing-out device, for example that shown in FIGS. 7 to 9, are explained schematically by way of two curves K1 and K2 in the diagram according to FIG. 10. In the diagram according to FIG. 10, the time t is plotted on the x-axis and the distance s which can be covered by the movable furniture part is plotted on the y-axis.

The curve K1 describes a closing operation 1 for example of a drawer in a basic structure. The curve K1 begins at a time t0=0 for a distance point s1, the curve K1 being obtained by means of the information obtained from the Hall sensor. As the drawer, which is moving in the direction of the closure position from distance point s1, approaches, the second distance point s2, at which the drawer assumes a standstill position, is reached at the time t1. The distance point s2 corresponds to a lower value than the distance point s1 since s2 is closer to a zero point on the y-axis, where s=0, formed by a mechanical closing stop for the drawer. Once the drawer has reached the standstill position at t1 a new closure position is defined only when subsequently, within a time interval, e.g. $\delta t = t2 - t1$, there is no longer any further movement taking place, as a result of which, in this time interval, a distance $\delta s$ covered is essentially 0. For example it is possible for relatively small vibrations caused by, for example, an individual moving past the furniture part, or resulting distances over which the movable furniture part moves, and having a as of, for example, less than 5% or 1% of the entire region just in front of the mechanical closing stop, not to be taken into account as a movement. The time-change value e.g. $\delta t = t2 - t1$ is predeterminable and is stored in the control means. After the time t2, the newly defined closure position of the drawer is taken as a basis in the control unit and, for example, a movement of the drawer when in a triggering time window is understood as the triggering operation and the drawer is pushed out.

The curve K2 describes a further closing operation which is comparable to K1, the drawer being moved from the first distance point s1 to a further distance point s3, at which the drawer rests in a standstill position. The second distance point s3 according to curve K2 is located between the point of closure s2 according to curve K1 and the first distance point s1. This means that the drawer, upon closure according to curve K2, has not been closed to the same extent as during the closing operation according to curve K1, or the closure position reached at distance point s3 is further away from the mechanical closing stop for the drawer at s=0 than the distance point s2 according to curve K1.

LIST OF DESIGNATIONS

1 Piece of furniture
2 Basic structure
2*a* Rear wall
2*b* Side wall
2*c* Side wall
3 Drawer
3*a* Front portion
3*b* Rear wall
4 Pull-out guide
5 Front gap
6 Pushing-out device
7 Pushing-out lever
7*a* Abutment side
8*a* Crossmember
8*b* Crossmember
9*a* Accommodating flange
9*b l Accommodating flange*
10 Electric motor
11 Gear mechanism
12 Transmission element
13 Transmission element
14 Transmission element
15 Rotary shaft
16 Sensor

16*a* Sensor part
16*b* Sensor part
17 Fitting clip

We claim:

1. A device for moving a movable furniture part which is accommodated on a fixed furniture part, said device comprising: a pushing-out element which is driven via a drive unit and is present on one of the furniture parts and pushes the movable furniture part out of a closure position, wherein contact between the pushing-out element and the other furniture part is eliminated during a pushing-out operation, and a control unit for controlling the drive unit, wherein the control unit (i) stores a definable closure position of the movable furniture part for controlling the drive unit, and (ii) following a closing operation of the movable furniture part, defines a standstill position achieved as a result of the closing operation as a new closure position to replace the definable closure position previously stored in the control unit.

2. The device as claimed in claim 1, wherein a new closure position is defined when, following the closing operation, the movable furniture part is stationary in a standstill position that is within a predetermined distance in the vicinity of a mechanical closing stop of the movable furniture part.

3. The device as claimed in claim 2, wherein a new closure position is defined when no significant movement of the movable furniture part takes place within a predefined period of time from the point in time at which the standstill position is reached.

4. The device as claimed in claim 2, wherein a new closure position is not defined when, beyond a predefined period of time calculated from the point in time at which the standstill position is reached, there is no longer any significant movement of the movable furniture part taking place.

5. The device as claimed in claim 1, further comprising a sensor for detecting a movement state of the movable furniture part.

6. The device as claimed in claim 5, wherein the sensor detects the movement state of the movable furniture part indirectly via sensing of the movement of the pushing-out element.

7. The device as claimed in claim 5, wherein the sensor comprises two sensor parts, wherein one sensor part is arranged on one of a fixed-position part of the pushing-out device and the fixed furniture part, and the other sensor part is arranged on one of the pushing-out element and the movable furniture part.

8. The device as claimed in claim 5, wherein the sensor comprises a Hall sensor.

9. The device as claimed in claim 5, wherein the sensor feeds to the control unit information relating to a sensed movement state of the movable furniture part.

10. A piece of furniture with a furniture part that is movable relative to a fixed furniture part, the piece of furniture having a device as claimed in claim 1.

11. The device as claimed in claim 1, wherein the control device starts a closing operation at time t1 and stops the moveable furniture part at the standstill position between a starting position and a mechanical stop at time t2 and defines the standstill position as the new closure position when a distance covered by the moveable furniture part during the time period t2–t1 is less than 5% of the region in front of the mechanical stop.

12. The device as claimed in claim 1, wherein the control device starts a closing operation at time t1 and stops the moveable furniture part at the standstill position that is before the closure position and farther from a mechanical stop at time t2.

* * * * *